US010533815B1

(12) United States Patent
Chang et al.

(10) Patent No.: US 10,533,815 B1
(45) Date of Patent: Jan. 14, 2020

(54) ADJUSTABLE HANDLE AUXILIARY DEVICE

(71) Applicants: Chia-Jung Chang, Taipei (TW); Xuan-Zun Liao, Taipei (TW)

(72) Inventors: Chia-Jung Chang, Taipei (TW); Xuan-Zun Liao, Taipei (TW)

( * ) Notice: Subject to any disclaimer, the term of this patent is extended or adjusted under 35 U.S.C. 154(b) by 0 days.

(21) Appl. No.: 16/298,346

(22) Filed: Mar. 11, 2019

(51) Int. Cl.
*F41A 3/20* (2006.01)
*F41A 3/72* (2006.01)

(52) U.S. Cl.
CPC . *F41A 3/20* (2013.01); *F41A 3/72* (2013.01)

(58) Field of Classification Search
CPC ..... F41A 3/20; F41A 3/72; F41A 3/64; F41A 5/18; F41A 11/02; F41A 3/18
USPC ..... 89/16
See application file for complete search history.

(56) References Cited

U.S. PATENT DOCUMENTS 4,672,762 A * 6/1987 Nilsson ..... F41A 3/20 42/16
5,926,988 A * 7/1999 Casull ..... F41A 3/72 42/16
6,019,024 A * 2/2000 Robinson ..... F41A 3/72 89/1.42
7,231,861 B1 * 6/2007 Gauny ..... F41A 3/72 42/16
8,863,632 B1 * 10/2014 O'Malley ..... F41A 3/72 42/16
9,897,406 B2 * 2/2018 Oz ..... F41A 35/06
2002/0046642 A1 * 4/2002 Murello ..... F41A 3/72 89/1.42
2013/0174457 A1 * 7/2013 Gangl ..... F41A 3/18 42/16
2014/0345444 A1 * 11/2014 Hillman ..... G01N 15/06 89/1.4
2015/0121734 A1 * 5/2015 Kresser ..... F41A 3/72 42/16
2018/0112939 A1 * 4/2018 Wheatley ..... F41A 3/72
2018/0195820 A1 * 7/2018 Noonan ..... F41A 3/72
2018/0266779 A1 * 9/2018 Reynolds ..... F41A 3/72
2019/0154382 A1 * 5/2019 Pizano ..... F41A 5/18
2019/0257601 A1 * 8/2019 Brown ..... F41A 3/12
2019/0277588 A1 * 9/2019 Amar ..... F41A 35/06
2019/0277589 A1 * 9/2019 Fischbach ..... F41A 3/72

* cited by examiner

*Primary Examiner* — Joshua E Freeman
*Assistant Examiner* — Bridget A Cochran
(74) *Attorney, Agent, or Firm* — Thomas J. Nikolai; DeWitt LLP

(57) ABSTRACT

An adjustable handle auxiliary device includes a main handle body, a handle, a resting part, a tank body and at least one clamping part. The main handle body has one side having a docking portion, and one end edge having a combination tooth portion. The handle has a combination portion. The combination portion and the docking portion can be mutually combined together. The resting part has one side having a resting slot and the other side having a toothed combination slot. The toothed combination slot and the combination tooth portion can be mutually combined together. The tank body is formed with a chamber. The main handle body is disposed in the chamber. The tank body is provided with multiple jointing members. The clamping part includes a first clamping member, a second clamping member and a third clamping member combined together. The second and third clamping members clamp the jointing members.

12 Claims, 10 Drawing Sheets

ADJUSTABLE HANDLE AUXILIARY DEVICE

BACKGROUND OF THE INVENTION

(1) Field of the Invention

The invention relates to an adjustable handle auxiliary device capable of achieving an objective of rapidly and accurately pulling a bolt.

(2) Description of the Prior Art

At present, when an ordinary gun is used, the user's hand needs to pull a bolt handle to complete the loading operation of the gun. In addition, when the user is pulling the bolt handle thereof, the distance from the gun to the body is shorter, so the hand needs to pull the bolt handle at the trickier angle or with the trickier gesture to pull the bolt handle to the bottom and move the bolt to complete the loading operation of the gun. This often causes the problem of inconvenience on the user's operation.

So, how to improve the above-mentioned drawback and problem is the technical difficulty that the inventor of this case wants to solve.

SUMMARY OF THE INVENTION

To achieve the above-identified object, the invention provides an adjustable handle auxiliary device including a main handle body, a handle, a resting part, a tank body and at least one clamping part. The main handle body has one side having a docking portion, and one end edge having a combination tooth portion. The handle has a combination portion. The combination portion and the docking portion can be mutually combined together. One side of the resting part has a resting slot and the other side of the resting part has a toothed combination slot. The toothed combination slot and the combination tooth portion can be mutually combined together. The tank body is formed with a chamber. One side of the tank body is formed with a limit guiding slot. The main handle body is disposed in the chamber. The handle is movable in the limit guiding slot. The tank body is provided with multiple jointing members. The clamping part includes a first clamping member, a second clamping member and a third clamping member combined together. The second clamping member and the third clamping member clamp the jointing members. Thus, the handle auxiliary device can be assembled with a gun body. The resting slot of the resting part is disposed opposite a position of a bolt handle of the gun body. When the user pulls the handle backward to move the main handle body synchronously backward in the chamber, the resting part moves the bolt handle to achieve an objective of rapidly and accurately pulling a bolt.

DETAILED DESCRIPTION OF THE PREFERRED EMBODIMENTS

Figure 1:
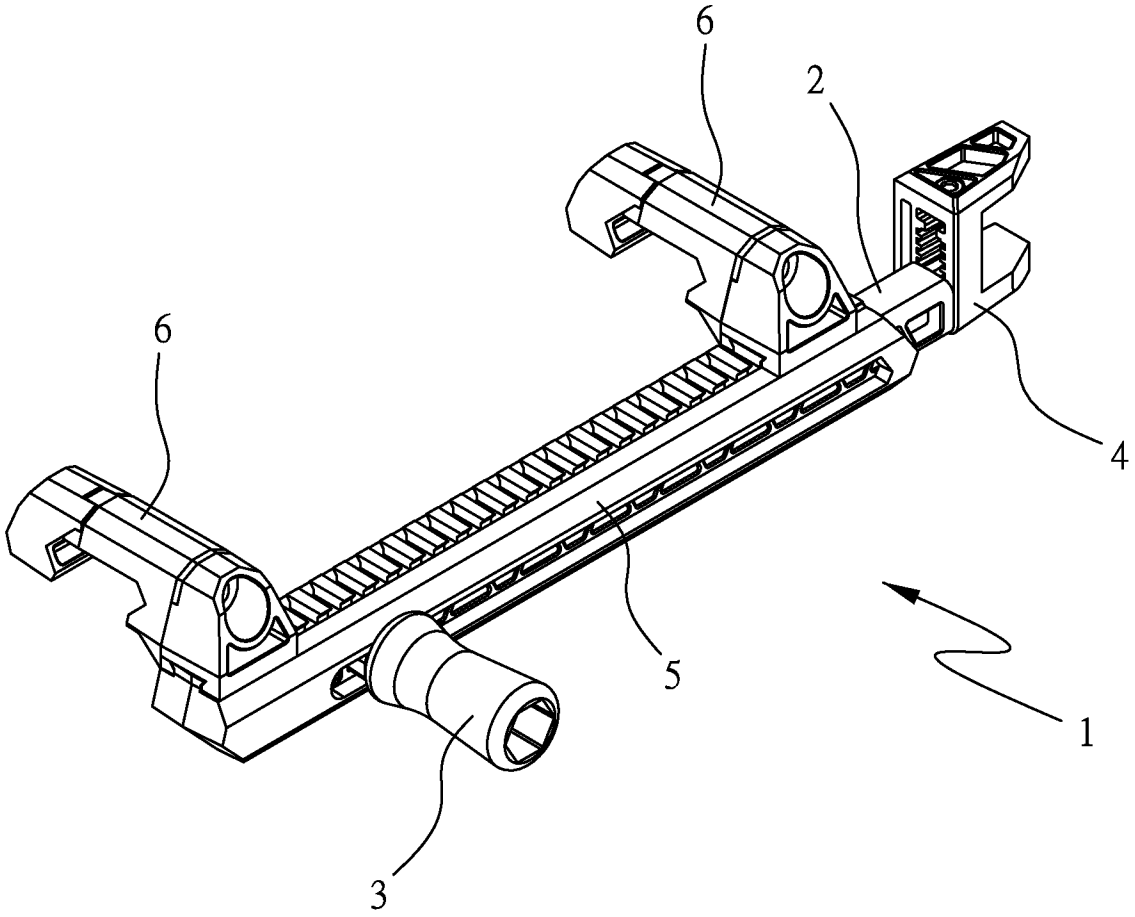
FIG. 1 is a pictorial outlook view of the invention.
Figure 2:
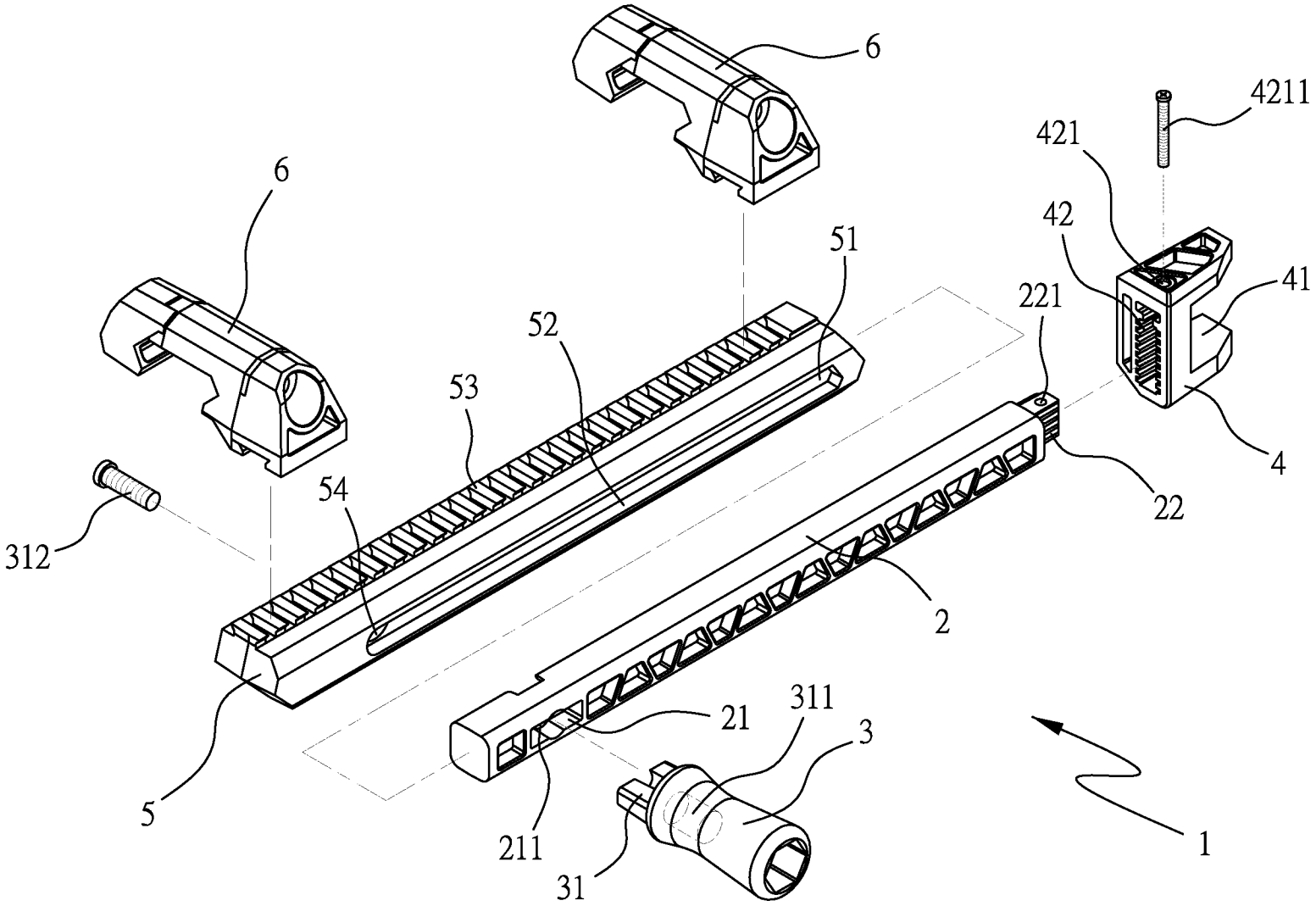
FIG. 2 is a pictorially exploded view of the invention.
Figure 3:
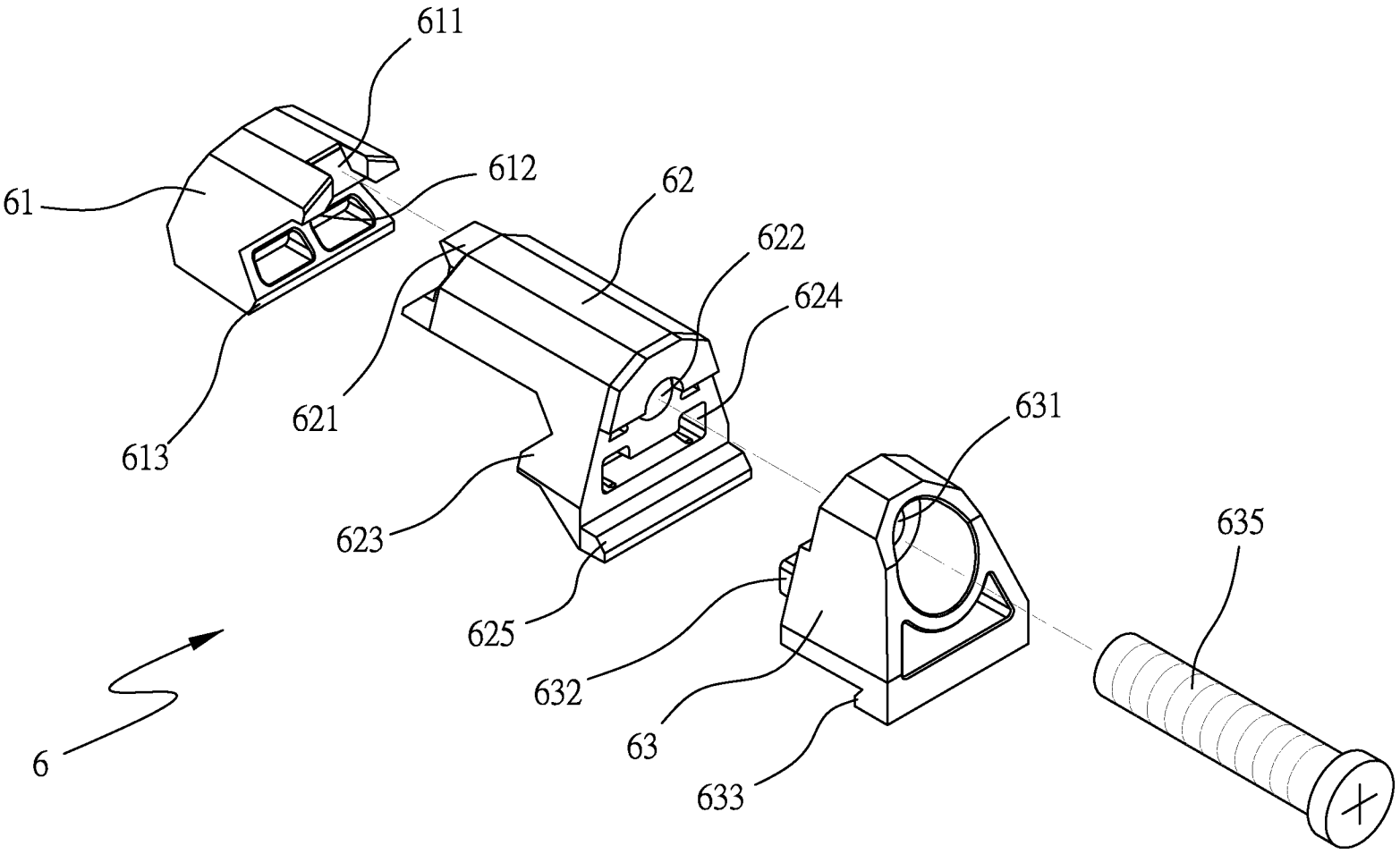
FIG. 3 is a first partially decomposed schematic view of the invention.
Figure 4:
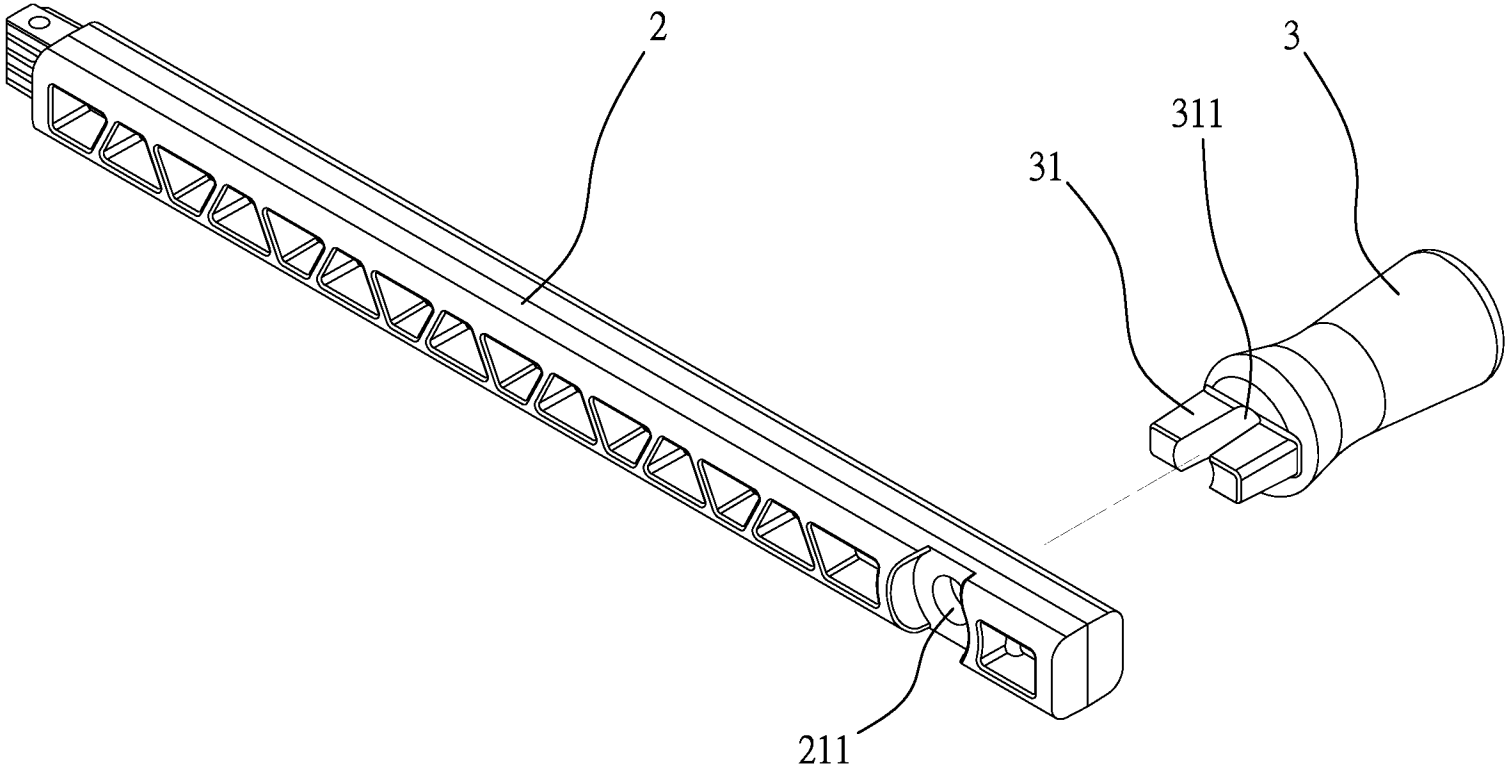
FIG. 4 is a second partially decomposed schematic view of the invention
Figure 5:
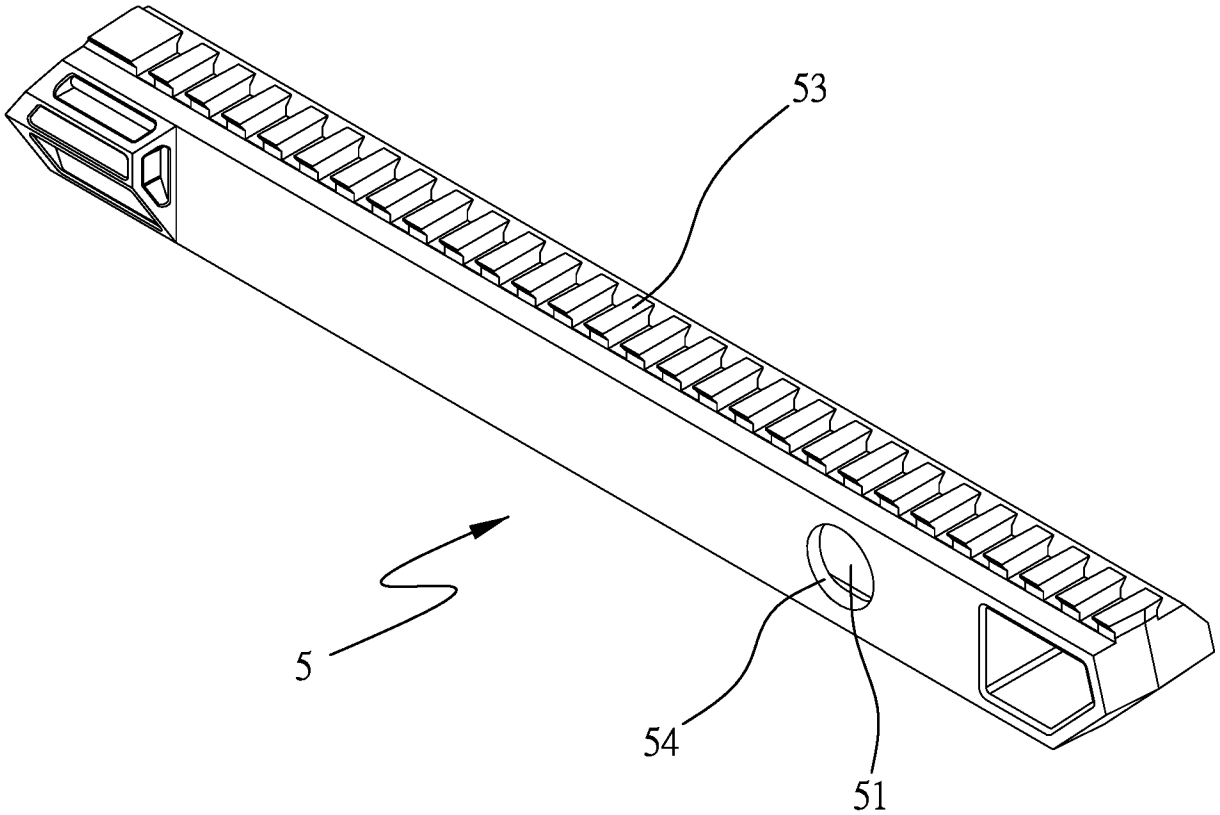
FIG. 5 is a third partially decomposed schematic view of the invention
Figure 6:
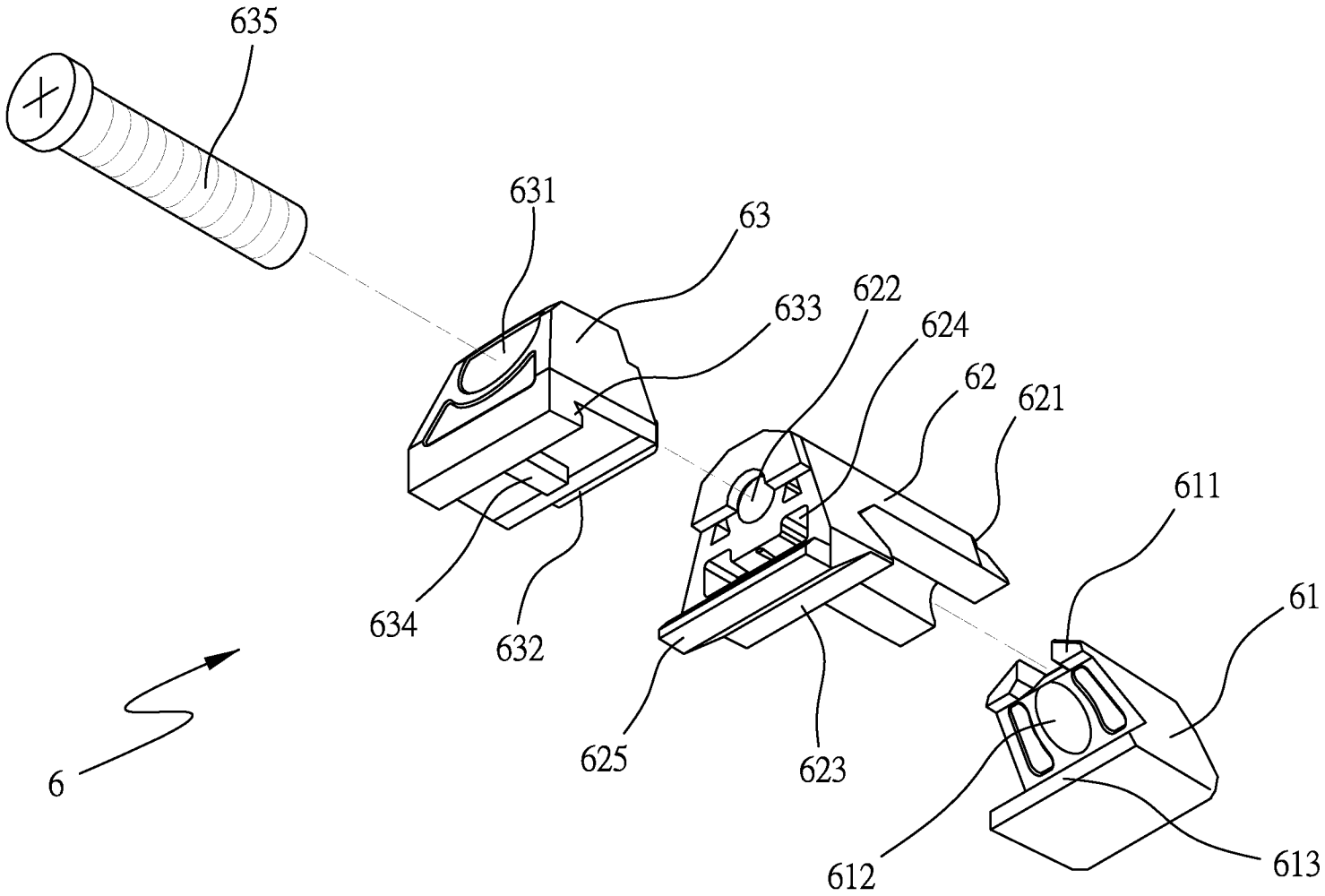
FIG. 6 is a fourth partially decomposed schematic view of the invention
Figure 7:
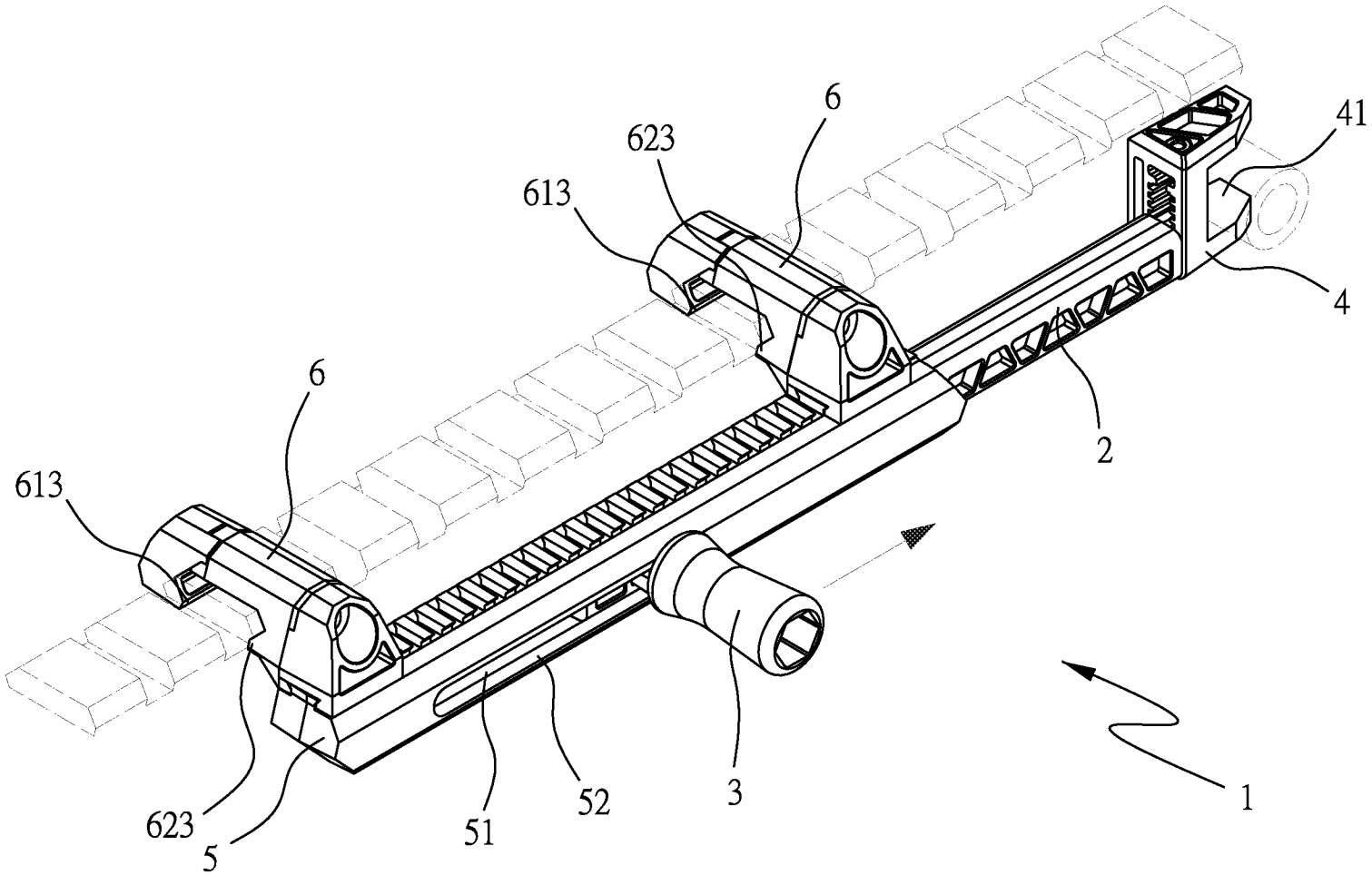
FIG. 7 is a first schematic view showing a preferred embodiment of the invention.
Figure 8:
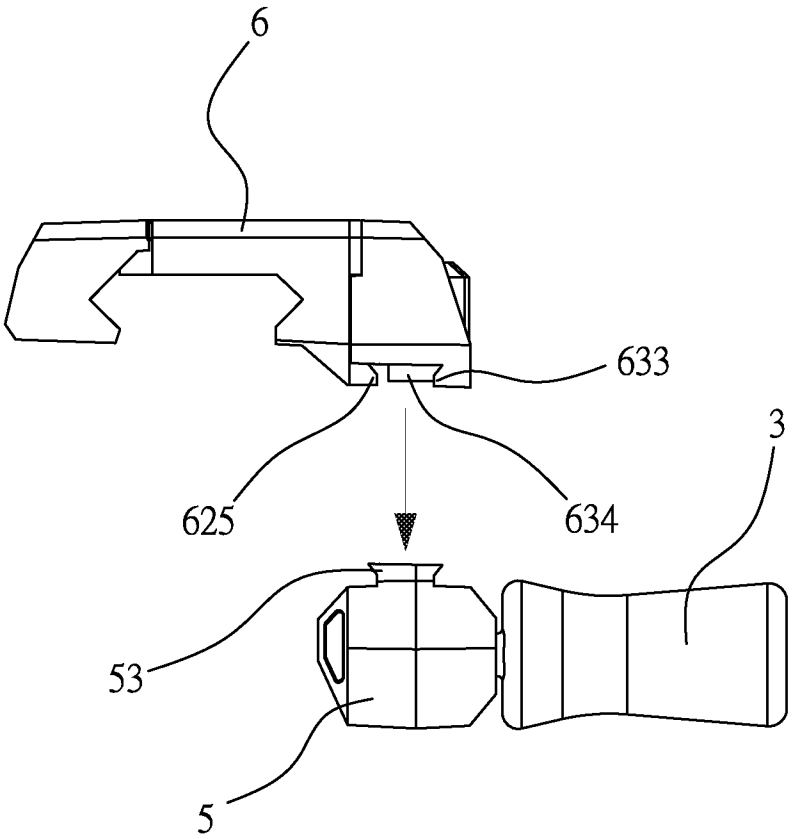
FIG. 8 is a second schematic view showing the preferred embodiment of the invention.
Figure 9:
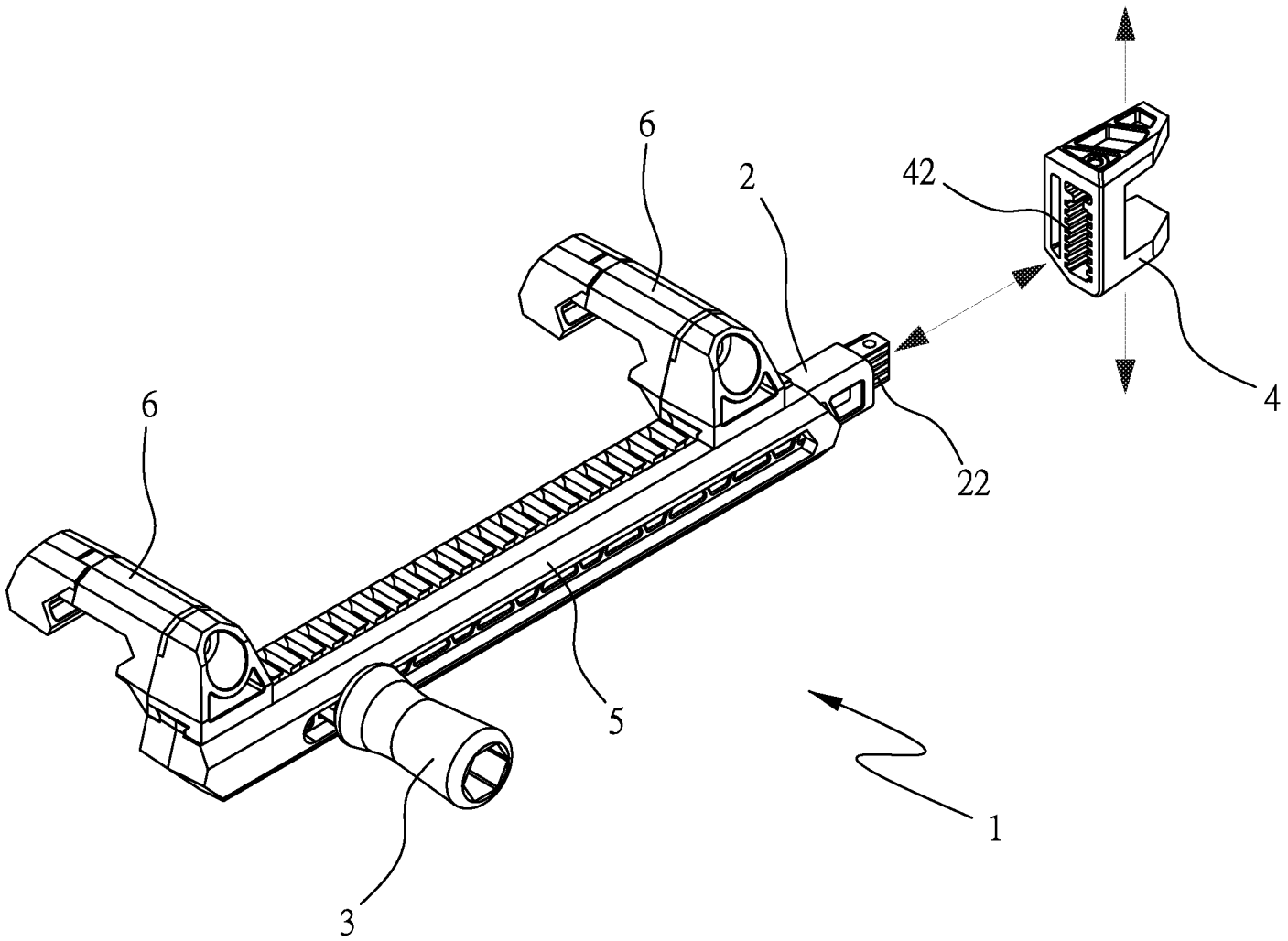
FIG. 9 is a third schematic view showing the preferred embodiment of the invention.
Figure 10:
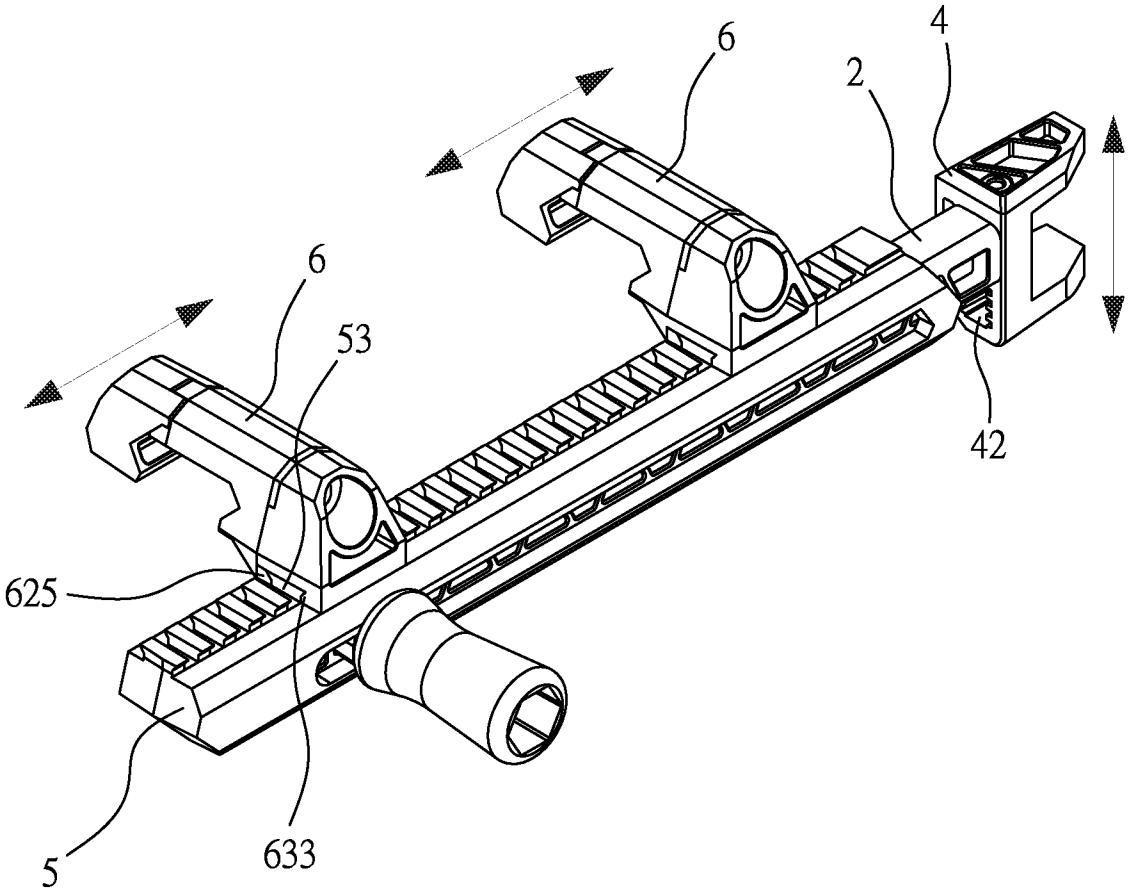
FIG. 10 is a fourth schematic view showing the preferred embodiment of the invention.

Please refer to FIGS. 1 to 10 concurrently. FIGS. 1 to 10 are respectively a pictorial outlook view, a pictorially exploded view, first to fourth partially decomposed schematic views and first to fourth schematic views showing the preferred embodiment of the invention. As shown in the drawings, it is obtained that a handle auxiliary device 1 includes a main handle body 2, a handle 3, a resting part 4, a tank body 5 and at least one clamping part 6.

One side of the main handle body 2 has a docking portion 21. A middle of the docking portion 21 is formed with a screw-member through hole 211. An end edge of the main handle body 2 has a combination tooth portion 22. The combination tooth portion 22 has a first through hole 221.

The handle 3 has a combination portion 31. A middle of the combination portion 31 has a combination hole 311. The handle 3 further has a combination screw member 312.

One side of the resting part 4 has a resting slot 41, and the other side of the resting part 4 opposite the resting slot 41 has a toothed combination slot 42. The toothed combination slot 42 and the combination tooth portion 22 can be mutually combined together, and the toothed combination slot 42 has a second through hole 421.

The tank body 5 is formed with a chamber 51 therein. One side of the tank body 5 is formed with a limit guiding slot 52. The chamber 51 and the limit guiding slot 52 communicate with each other. The tank body 5 is provided with multiple jointing members 53.

The clamping part 6 includes a first clamping member 61, a second clamping member 62 and a third clamping member 63 combined together. One end of the first clamping member 61 has a positioning slot 611, and one end of the second clamping member 62 has a positioning portion 621. The positioning portion 621 and the positioning slot 611 can be mutually combined together, so that the first clamping member 61 and the second clamping member 62 can be mutually combined together. One side of the third clamping member 63 has an assembling portion 632.

The docking portion 21 and the combination portion 31 can be mutually combined together;

A fixing member 4211 passes through the first through hole 221 and the second through hole 421 to fix the toothed combination slot 42 and the combination tooth portion 22.

The main handle body 2 is disposed in the chamber 51, and the handle 3 is movable in the limit guiding slot 52.

The jointing members 53 are disposed on the tank body 5 in an equally-spaced manner.

The other side of the tank body 5 further has a hole 54, through which the combination screw member 312 passes.

The combination screw member 312 can be disposed on the combination hole 311 through the screw-member through hole 211 to really fix the combination portion 31 onto the docking portion 21.

The other end of the first clamping member 61 has a first clamp portion 613. The other end of the second clamping member 62 has a second clamp portion 623.

One side of the second clamping member 62 has an engaging slot 624, and the engaging slot 624 and the assembling portion 632 can be mutually combined together, so that the second clamping member 62 and the third clamping member 63 can be mutually combined together. A third clamp portion 625 is provided at a bottom end position of the second clamping member 62 neighboring the engaging slot 624.

A fourth clamp portion 633 is provided at a bottom end position of third clamping member 63. The fourth clamp portion 633 is extended with a fixing portion 634 toward a position of the third clamp portion 625. The fixing portion 634 can pass through and be positioned at the jointing members 53.

The first clamping member 61 has a screw hole 612, the second clamping member 62 has a penetrating part 622, and the third clamping member 63 has a hole portion 631.

A screw member 635 passes through the hole portion 631, the penetrating part 622 and the screw hole 612, and the screw member 635 is fixed to the screw hole 612.

The main assembling processes are described in the following. The toothed combination slot 42 of the resting part 4 and the combination tooth portion 22 of the main handle body 2 can be mutually combined together. The toothed combination slot 42 and the combination tooth portion 22 can be adjusted to proper positions and then assembled together. The fixing member 4211 passes through the first through hole 221 and the second through hole 421 to fix the toothed combination slot 42 and the combination tooth portion 22; the main handle body 2 is disposed in the chamber 51 of the tank body 5; and the combination portion 31 of the handle 3 and the docking portion 21 of the main handle body 2 can be mutually combined together.

The combination screw member 312 passes the hole 54, and the combination screw member 312 can be disposed on the combination hole 311 through the screw-member through hole 211, so that the combination portion 31 is really fixed onto the docking portion 21, and the handle 3 is movable in the limit guiding slot 52. The third clamping member 63 of the clamping part 6 has the fixing portion 634. The fixing portion 634 passes through and is positioned at the jointing members 53. The engaging slot 624 of the second clamping member 62 and the assembling portion 632 of the third clamping member 63 can be mutually combined together. That is, the fourth clamp portion 633 at the bottom end position of the third clamping member 63 and the third clamp portion 625 at the bottom end position of the second clamping member 62 neighboring the engaging slot 624 can clamp the jointing members 53, so that the second clamping member 62 and the third clamping member 63 can be mutually combined together. The fixing portion 634 passes through and is positioned at the jointing members 53, so that the fourth clamp portion 633 and the third clamp portion 625 cannot be arbitrarily moved onto the jointing members 53. Furthermore, the positioning portion 621 on one end of the second clamping member 62 and the positioning slot 611 on one end of the first clamping member 61 can be mutually combined together, so that the first clamping member 61 and the second clamping member 62 can be mutually combined together. The first clamping member 61 has the screw hole 612, the second clamping member 62 has the penetrating part 622 and the third clamping member 63 has the hole portion 631. Finally, the screw member 635 penetrates through the hole portion 631, the penetrating part 622 and the screw hole 612 and fixes the screw member 635 onto the screw hole 612. Because the jointing members 53 are disposed on the tank body 5 in an equally-spaced manner, the second clamping member 62 and the third clamping member 63 of the clamping part 6 can be adjusted to proper positions on the jointing members 53 and then assembled together, and one or multiple clamping parts 6 can be combined with the tank body 5 according to the requirement.

In summary, the handle auxiliary device 1 can be mounted on a gun body through the first clamp portion 613 of the first clamping member 61 and the second clamp portion 623 of the second clamping member 62 of the clamping part 6; a bolt handle is disposed at a rear end position of the gun body; the third clamp portion 625 and the fourth clamp portion 633 clamp the jointing members 53; the main handle body 2, the handle 3 and the resting part 4, which have been assembled, are disposed in the chamber 51; and the resting slot 41 of the resting part 4 is disposed at the position of the bolt handle. When the user pulls the handle 3, the handle 3 drives the main handle body 2 to move in the chamber 51, and the handle 3 is movable in the limit guiding slot 52. At the same time, the resting slot 41 pushes and moves the bolt handle to achieve the objective of pulling the bolt and loading the gun. Thus, the user can pull the handle 3 from the lateral side to prevent the bolt handle from being directly pulled, and the user' hand needs not to bend at a large angle or the user needs not to change the posture or angle of holding the gun, so that various problems of causing inconvenience upon pulling the bolt handle can be reduced.

New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. An adjustable handle auxiliary device, comprising: a main handle body, wherein one side of the main handle body has a docking portion, a middle of the docking portion is formed with a screw-member through hole, an end edge of the main handle body has a combination tooth portion, and the combination tooth portion has a first through hole; a handle, wherein the handle has a combination portion, a middle of the combination portion has a combination hole, and the handle further has a combination screw member; a resting part, wherein one side of the resting part has a resting slot, the other side of the resting part opposite the resting slot has a toothed combination slot, the toothed combination slot and the combination tooth portion are configured to be mutually combined together, and the toothed combination slot has a second through hole; a tank body, wherein the tank body is formed with a chamber, one side of the tank body is formed with a limit guiding slot, the chamber and the limit guiding slot communicate with each other, and the tank body is provided with multiple jointing members; and at least one clamping part comprising a first clamping member, a second clamping member and a third clamping member combined together, wherein one end of the first clamping member has a positioning slot, one end of the second clamping member has a positioning portion, and the positioning portion and the positioning slot are configured to be mutually combined together, so that the first clamping member and the second clamping member are configured to be mutually combined together, wherein one side of the third clamping member has an assembling portion.

2. The adjustable handle auxiliary device according to claim 1, wherein the docking portion and the combination portion are configured to be mutually combined together.

3. The adjustable handle auxiliary device according to claim 1, wherein a fixing member passes through the first through hole and the second through hole to fix the toothed combination slot and the combination tooth portion.

4. The adjustable handle auxiliary device according to claim 1, wherein the main handle body is disposed in the chamber, and the handle is movable in the limit guiding slot.

5. The adjustable handle auxiliary device according to claim 1, wherein the jointing members are disposed on the tank body in an equally-spaced manner.

6. The adjustable handle auxiliary device according to claim 1, wherein the other side of the tank body further has a hole, through which the combination screw member passes.

7. The adjustable handle auxiliary device according to claim 1, wherein the combination screw member is configured to be disposed on the combination hole through the screw-member through hole to really fix the combination portion onto the docking portion.

8. The adjustable handle auxiliary device according to claim 1, wherein the other end of the first clamping member has a first clamp portion, and the other end of the second clamping member has a second clamp portion.

9. The adjustable handle auxiliary device according to claim 1, wherein one side of the second clamping member has an engaging slot, and the engaging slot and the assembling portion are configured to be mutually combined together, so that the second clamping member and the third clamping member are configured to be mutually combined together, wherein a third clamp portion is provided at a bottom end position of the second clamping member neighboring the engaging slot.

10. The adjustable handle auxiliary device according to claim 1, wherein a fourth clamp portion is provided at a bottom end position of the third clamping member, the fourth clamp portion is provided with a fixing portion, and the fixing portion is configured to pass through and be positioned at the jointing members.

11. The adjustable handle auxiliary device according to claim 1, wherein the first clamping member has a screw hole, the second clamping member has a penetrating part, and the third clamping member has a hole portion.

12. The adjustable handle auxiliary device according to claim 11, wherein a screw member passes through the hole portion, the penetrating part and the screw hole, and the screw member is fixed to the screw hole.

* * * * *